US005230575A

United States Patent [19]

Kulesa et al.

[11] Patent Number: 5,230,575

[45] Date of Patent: Jul. 27, 1993

[54] SEGMENTED INK RESERVOIR

[75] Inventors: Larry B. Kulesa, Bothell; Grant W. Beach, Seattle, both of Wash.

[73] Assignee: Mannesmann Tally Corporation, Kent, Wash.

[21] Appl. No.: 887,485

[22] Filed: May 20, 1992

[51] Int. Cl.[5] ..... B41J 27/12

[52] U.S. Cl. ..... 400/202.1; 400/197; 400/202.4

[58] Field of Search ..... 400/196.1, 200-202.4, 400/197

[56] References Cited

U.S. PATENT DOCUMENTS

| | | | |
|---|---|---|---|
| 1,846,498 | 2/1932 | Stephenson | 402/202 |
| 2,185,342 | 1/1940 | Keller | 101/350 |
| 2,727,462 | 12/1955 | Alessi, Jr. | 101/367 |
| 2,990,771 | 7/1961 | Herrick | 101/367 |
| 3,951,253 | 4/1976 | Tibay et al. | 197/171 |
| 4,037,709 | 7/1977 | Tibay | 400/202.1 |
| 4,091,914 | 5/1978 | Stipanuk | 400/196.1 |
| 4,399,751 | 8/1983 | Kessler | 400/202.4 |
| 4,416,201 | 11/1983 | Kessler | 400/202.4 |
| 4,458,399 | 7/1984 | Kessler | 29/148.4 D |
| 4,601,594 | 7/1986 | Hayashi et al. | 400/196.1 |
| 4,616,942 | 10/1986 | Nagasawa et al. | 400/196.1 |

*Primary Examiner*—Edgar S. Burr
*Assistant Examiner*—Lynn D. Hendrickson
*Attorney, Agent, or Firm*—Christenson, O'Connor, Johnson & Kindness

[57] ABSTRACT

An ink reservoir (34) capable of maintaining an even distribution of a single color of ink on a printer ribbon is provided. The ink reservoir is used in ribbon cassettes (10) for typewriters and dot matrix printers. The ink reservoir (34) includes a series of cylindrical ink-carrying elements (50) separated by a series of separating sheets (52). The separating sheets (52) restrict or prevent the flow of ink from one ink-carrying element to another element. This maintains an even distribution of ink throughout the height of the reservoir which, in turn, results in an even transfer of ink from the ink reservoir onto a transfer roller and subsequently onto a ribbon. The even distribution of ink in the ribbon results in an even distribution of ink in the characters printed using the ribbon and, thus, improves print quality.

18 Claims, 4 Drawing Sheets

SEGMENTED INK RESERVOIR

FIELD OF THE INVENTION

This invention relates to re-inking devices for typewriter and printer ribbons and, more particularly, to re-inking reservoirs for ribbon cassettes.

BACKGROUND OF THE INVENTION

In present day typewriters, dot matrix serial printers, and dot matrix line printers, it is common practice to include a ribbon cassette having a continuous one-piece ribbon that is moved past the print hammers during printing. It is also common practice for the ribbon cassettes to contain an ink reservoir that either periodically or continuously re-inks the ribbon. The ink reservoirs are generally located in contact with a transfer roller that, in turn, contacts the ribbon as the ribbon enters the cassette after it moves between the print hammers and paper. Typically, as the ribbon enters the cassette, ink flows the ink reservoir onto the surface of a transfer roller and then onto the ribbon.

Some ribbon cassettes store the ribbon within the cassette in a random fashion. The ribbon is unfolded from such cassettes as the ribbon exits the cassette. Upon reentering the ribbon cassette, after passing in front of the print hammers, the ribbon is re-inked prior to being randomly folded. Such ribbons often have a Möbius loop configuration, which allows the print hammers to equally impact both sides of the ribbon. This configuration tends to increase ribbon life by decreasing ribbon wear.

As a ribbon's useful lifetime has been extended due to improvements in materials, etc., it has become more important to properly and effectively re-ink the ribbon in order to obtain good quality print throughout the life of the ribbon. In the past, ink reservoirs have typically been formed of an open cell material such as a foam or sponge. Open cell materials are capable of absorbing large quantities of ink while allowing the ink to flow freely from the surface of the ink reservoir onto the transfer roller and, in turn, onto the ribbon as the ribbon contacts the transfer roller.

In addition to allowing ink to flow from the surface of the ink reservoir onto the transfer roller, open cell materials also allow ink to move freely within the reservoir. This leads to a disadvantage. Specifically, because ink flows freely within the open cell materials used to form the ink reservoir, gravity causes ink to pool in the lower portion of the ink reservoir. Thus, the density of the ink at the bottom of the reservoir is greater than at the top. This reservior ink gradient results in a greater flow of ink onto the lower portion of the transfer roller than the upper portion. Consequently, more ink is transferred to the lower portion of the ribbon. If the ribbon is contained within the case in a Möbius loop, after more than one revolution of the ribbon, more ink is transferred to the upper and lower portions of the ribbon than the center.

In the case of a dot matrix serial printer, the upper and lower portions of a character printed with a ribbon that has been re-inked using prior art re-inking mechanisms of the type described above has a denser ink distribution than the center portion. Because such print is darker and more defined at the top and bottom than at the center, print quality is less than desired. In the case of dot matrix line printers, the ribbon is generally oriented in front of the print hammers such that one edge of the row of hammers contacts the bottom of the ribbon while the other edge of the row of hammers contacts the top of the ribbon. This configuration allows different hammers to contact different sections of the ribbon, thus decreasing ribbon wear. The print of a line printer using a ribbon re-inked using prior art re-inking mechanisms shows that a lower print density is produced at the center of the page than at the edges, thus reducing print quality.

Therefore, there exists a need for a new type of ink reservoir that is capable of maintaining an even distribution of ink supplied to the transfer roller. This will result in an even distribution of ink being transferred from the transfer roller to the ribbon as the ribbon contacts the transfer roller. An even distribution of ink over the width of the ribbon will, in turn, result in improved print quality.

SUMMARY OF THE INVENTION

The present invention provides an ink reservoir having a relatively even distribution of a single color of ink throughout the reservoir. The even distribution of ink in the reservoir results in an even flow of ink from the reservoir onto a transfer roller and then a ribbon. The even distribution of ink throughout the ribbon improves the evenness of the distribution of ink to characters printed with the ribbon, resulting in improved print quality. An ink reservoir formed in accordance with this invention comprises a plurality of vertically stacked ink-carrying elements separated from each other by separating sheets. Each ink-carrying element is formed from a porous material, preferably a porous foam, such as a polyester or polyurethane foam. The separating sheets prevent ink in one ink-carrying element from flowing to another ink-carrying element. As a result, an even vertical distribution of ink is maintained.

According to other aspects of the invention, the ink-carrying elements are cylindrical and positioned to rotatably engage a transfer roller such that ink flows from the ink-carrying elements onto the transfer roller.

According to still other aspects of this invention, the ink reservoir also includes a cylindrical sleeve surrounding and in fluid contact with the ink-carrying elements. The cylindrical sleeve, which is also in contact with the transfer roller, is formed of a material more dense than the material from which the ink-carrying elements are formed.

Preferably, the ink reservoir is rotatably mounted within a ribbon cassette such that it rotatably engages the transfer roller. The transfer roller, in turn, rotatably engages the ribbon. Thus, ink flows from the ink reservoir onto the ribbon via the transfer roller. The ink reservoir is biased against the transfer roller to ensure that the ink reservoir and transfer roller remain in fluid contact.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

Figure 1:
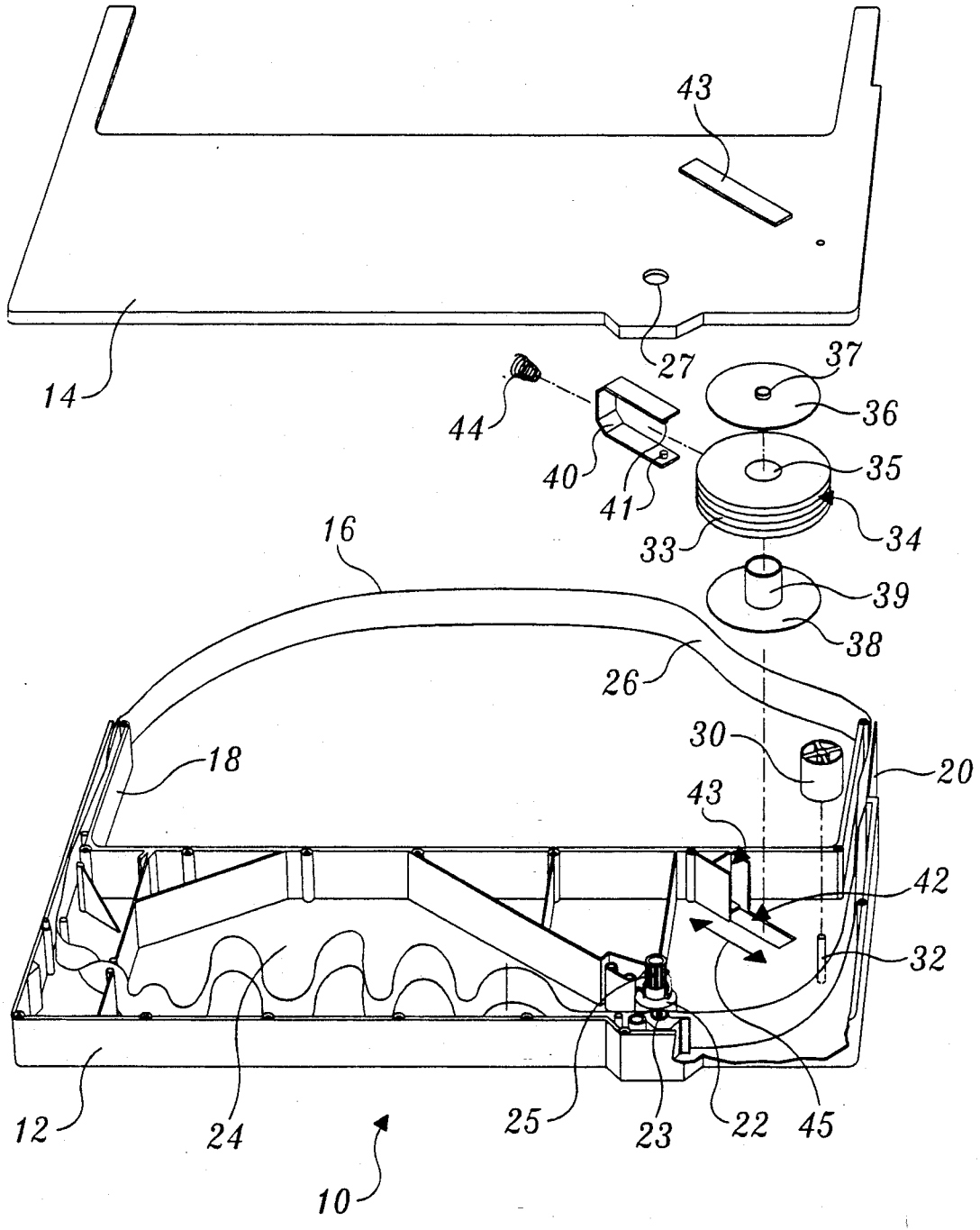
FIG. 1 is an exploded view of a ribbon cassette containing an ink reservoir according to the present invention.

FIG. 1 illustrates a ribbon cassette 10 that includes an ink reservoir 34 formed according to the present invention. The ribbon cassette 10 includes a case 12 and a cover 14 that are adapted to enclose the internal parts of the ribbon cassette. The case 12 includes two substantially parallel channels 18 and 20 extending horizontally outward from opposite ends of the ribbon cassette. The two channels 18 and 20 define an exit out of and an entry into the interior of the ribbon cassette, respectively. A continuous ribbon 16 extends out through an opening in the exit channel 18 and spans the length of the ribbon cassette to an opening in the entry channel 20 where it reenters the ribbon cassette. After reentering the ribbon cassette, the ribbon runs the length of the channel 20, extends past a transfer roller 30 (described below) and then passes between two rotatably mounted rollers, a drive roller 22 and a pinch roller 23. The ribbon then enters a storage cavity 24 which is designed to hold the excess ribbon in a stuff box manner. The ribbon exits the far end of the storage cavity, makes a Möbius loop, and runs down the length and out of the end of the exit channel 18, as described above.

The ribbon 16 is a continuous loop, preferably in the form of a Möbius strip. This configuration allows the print hammers to alternately impact equally on both sides of the ribbon as the ribbon completes each revolution through the ribbon cassette, thereby increasing the ribbon's useful life. The ribbon 16 may be a woven, flexible nylon fabric or another material as is well-known in the art.

The ribbon is pulled out through the opening in the exit channel 18, across the distance between channels 18 and 20 and into the opening in the entry channel 20 by the action of the drive and pinch rollers 22 and 23. The drive and pitch rollers 22 and 23 are rotatably mounted in the case and pinch the ribbon 16 between their exterior surfaces, thus advancing the ribbon in a manner well-known in the art. In the preferred embodiment, drive roller 22 includes a drive shaft constructed to engage a drive mechanism in the printing equipment (not shown) in which the ribbon cassette is designed to be used. A protrusion 25 that extends upwardly through a hole 27 in the cover 14 allows a user to manually move the ribbon 16 through the ribbon cassette.

In operation, the ribbon cassette is placed in a printer (e.g., a dot matrix line printer) so that the portion of the ribbon that spans the exit and entry channels 18 and 20 passes between the print hammers and paper. During printing, the drive mechanism in the printer (not shown) engages the drive roller 22 and thus continuously advances the ribbon 16 in a manner well-known in the art. As the ribbon is moved, the portion of the ribbon exiting from between the drive rollers is stuffed into the storage cavity 24 and folds in a manner well-known in the art.

As the drive and pinch rollers 22 and 23 advance the ribbon, the interior surface 26 of the ribbon contacts the exterior surface of a transfer roller 30 rotatably mounted within the ribbon cassette on an axle 32. This causes the transfer roller 30 to rotatably contact the ink reservoir 34, which is mounted in the ribbon cassette in the manner described below. As a result, ink contained within the ink reservoir 34 flows from the reservoir onto the surface of the transfer roller 30 and from the transfer roller onto the interior surface of the ribbon 16. As well-known to those skilled in the ribbon cassette art, it is generally beneficial to use a transfer roller to transfer ink to a ribbon instead of allowing the ink reservoir to directly contact the ribbon. The transfer roller ensures a proper flow of ink from the reservoir onto the ribbon and prevents the ribbon from being saturated with ink when the ribbon is not being advanced.

Figure 2:
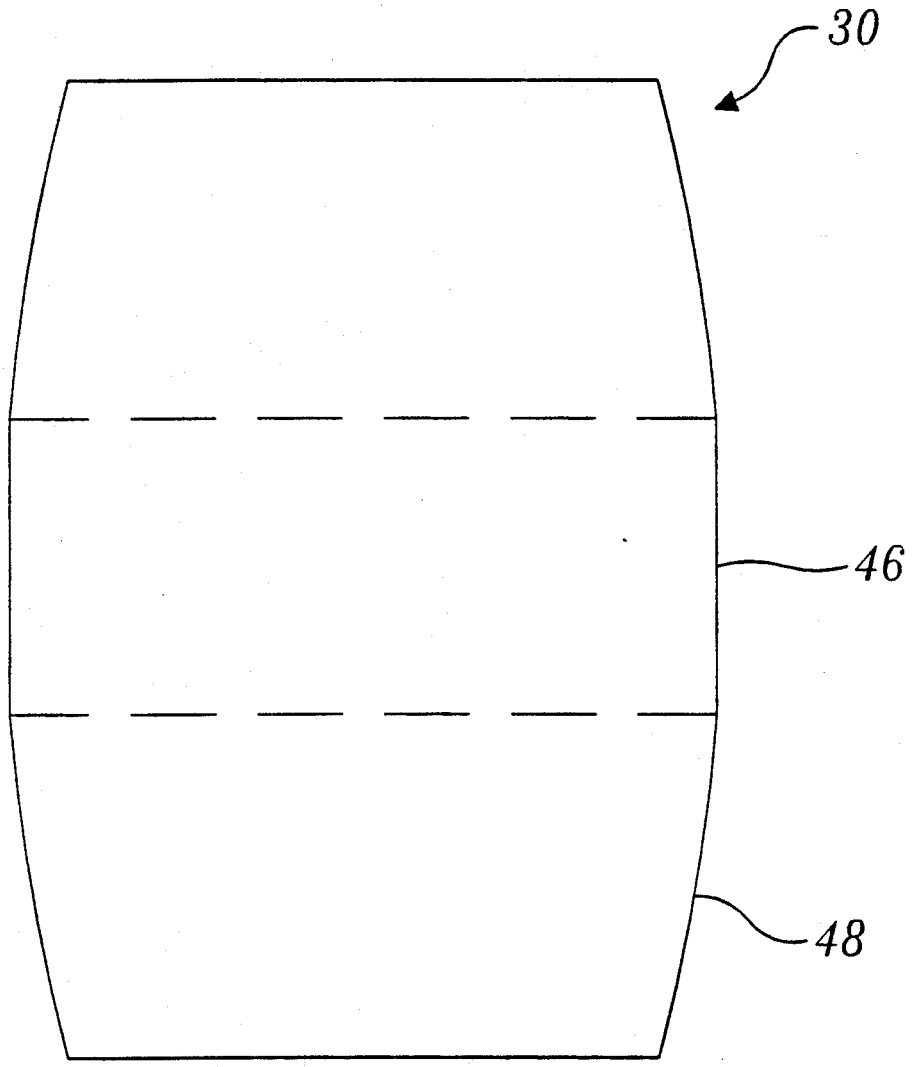
FIG. 2 is an enlarged side elevation view of the transfer roller of FIG. 1.

Referring now to FIG. 2, it may be advantageous to form the transfer roller 30 so that the center portion 46 of the transfer roller has a substantially constant cross-sectional area while the upper and lower portions 30 and 48 have decreasing cross-sectional areas (i.e., they converge) toward the top and bottom of the transfer roller, respectively. This configuration allows the ribbon 16 (not shown) to curve slightly over its width as the ribbon contacts the transfer roller, thus helping to ensure that the entire width of the facing surface of the ribbon 16 is in contact with the transfer roller. Complete contact between the transfer roller and the ribbon helps to ensure that ink is evenly transferred from the surface of the transfer roller onto the ribbon. It should be understood that although it is beneficial to form the transfer roller in the manner described above, other shapes and designs are also usable. Maintaining a proper film of ink on the transfer roller can also be improved by using a transfer roller with a rough exterior surface.

The ink reservoir 34, which is rotatably mounted within the interior of the ribbon cassette, holds enough ink to re-ink the ribbon for a minimum number of print characters, usually several million. Re-inking dramatically increases the useful life of a ribbon cassette. The ink reservoir 34 used in the ribbon cassette shown in FIG. 1 is cylindrical. Upper and lower mounting plates 36 and 38 and a U-shaped mounting bracket 40 are used to rotatably mount the ink reservoir 34 in the ribbon cassette. The lower mounting plate 38 is circular and includes an upwardly extending circular flange 39 that extends through a hole 35 in the center of the ink reservoir. The circular flange 39 contacts and engages the lower surface of the upper mounting plate 36. The upper mounting plate 36 is also circular and includes a hole 37 located at the center of the plate. A similar hole (not shown) is located in the bottom of the lower mounting plate. Both the upper and lower mounting plates 36 and 38 are rotatably mounted between the arms of the U-shape mounting bracket 40 such that the mounting plates and ink reservoir 34 are free to rotate. More specifically, located at the end of each of the arms of the mounting bracket 40 is a circular pin 41. The circular pins 41 face one another and rotatably engage the hole 37 in the upper mounting plate 36 and the similar hole (not shown) in the lower mounting plate 38.

The legs of the U-shaped mounting bracket 40 are received and slidably held within a channel 42 in the case 12 and a channel 43 on the interior side of the cover 14. The channels are sized and oriented such that the mounting bracket and thus ink reservoir 34 are slidable toward and away from the transfer roller 30, as shown by the arrow 45 in FIG. 1. That is, the channels lie along a radius line that extends outwardly from the shaft 32 on which the transfer roller 30 is mounted. A spring 44 located between the rear of the mounting bracket 40 and a cup-shaped housing 43 in the case 12 biases the mounting bracket and ink reservoir into contact with the transfer roller 30. The spring pressure ensures that the ink reservoir 34 remains in fluid contact with the transfer roller 30.

Figure 3:
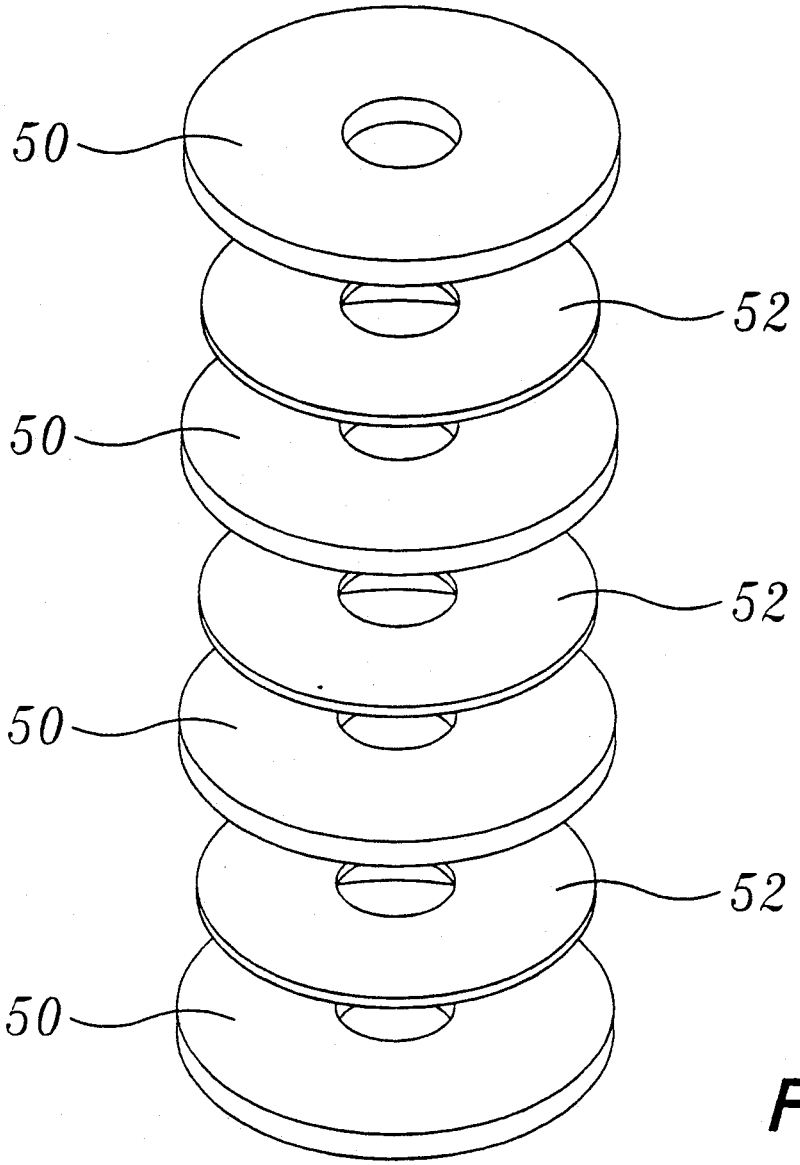
FIG. 3 is an enlarged, exploded view of a first embodiment of an ink reservoir according to the present invention.
Figure 4:
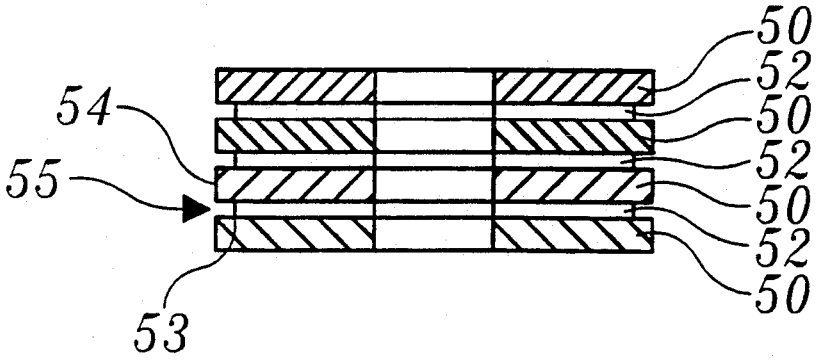
FIG. 4 is a cross-section, elevational view of the ink reservoir of FIG. 3.

FIGS. 3 and 4 illustrate a first preferred embodiment of an ink reservoir formed in accordance with this invention. The ink reservoir shown in FIGS. 3 and 4 comprises a plurality of vertically stacked ink-carrying elements 50 separated from each other by a series of separating sheets 52. The illustrated ink reservoir comprises four cylindrical ink-carrying elements 50 and three cylindrical separating sheets 52.

Each ink-carrying element 50 is formed from an open cell structure of reticulated foam material that is capable of storing ink such that the ink can flow to the edges of the cylindrical element and from the edges to the transfer roller 30. The presently preferred foam material is polyester or other polyurethane foam. It is beneficial to carefully select the density of the foam such that it holds a quantity of ink to ensure an appropriate useful lifetime, but is not so porous that it allows too much ink to flow from the exterior surface of the element onto the transfer roller. In accordance with the present invention, density refers to the ability of the foam material to contain a quantity of ink; a more dense foam material is not capable of holding as large a quantity of ink as a less dense foam material. A foam material's ability to hold ink is generally determined by the material density and the number of pores per inch in the foam material. While the presently optimum foam density prior to the foam receiving ink is between approximately 12 and 18 lb./ft.$^3$ having 70–110 pores per inch, it is to be understood that materials with other material and pore densities can be used to form the ink-carrying elements 50.

A separating sheet 52 is located between each pair of adjacent ink-carrying elements 50. The separating sheets restrict or prevent the flow of ink between the ink-carrying elements. Preferably, the separating sheets 52 are very thin. Thin separating sheets ensure even transfer of ink from the ink-carrying elements 50 to the transfer roller 30 and prevent the creation of a nonused region on the transfer roller. While optimum results have been obtained using a nonporous polyethylene sheet approximately 0.003 inches thick, it is to be understood that other materials and thickness can be used. Although the presently preferred separating sheets 52 are formed from a nonporous material, slightly porous separating sheets that allow a small amount of ink to flow between sections can also be used. Obviously, the porosity of the separating sheets must not allow sufficient ink flow to result in ink pooling in the lower ink-carrying elements 50.

It is also beneficial to make the diameter of the separating sheets 52 slightly less than the diameter of the ink-carrying elements 50. The smaller diameter ensures that the outer edge 53 of each separating sheet will be set back from the outer edge 54 of the adjacent ink-carrying elements 50. As shown in FIG. 4, the setbacks 55 ensure that the separating sheets do not extend beyond the outer edges 54 of the ink-carrying elements 50 and interfere with the transfer of ink from the elements to the transfer roller 30. While the presently preferred optimum set-back depth is approximately 0.05 inches, other set-back dimensions can be used.

Because each ink-carrying element 50 maintains its own supply of ink, and because the separating sheets 52 restrict or prevent ink from flowing between the individual elements 50, ink is prevented from pooling in the lower portion of the ink reservoir, as in prior art ink reservoirs. The distribution of ink throughout an ink reservoir formed in accordance with the invention can be tailored by tailoring the thickness, density, number of pores per inch, and number of ink-carrying elements 50 used to form the ink reservoir. The thickness of the ink reservoir and the application for which the reservoir is intended will usually determine the number of ink-carrying elements to be included in an ink reservoir formed in accordance with the invention. While in most applications it will be desirable to use ink-carrying elements of the same thickness, in some applications it may be beneficial to vary the thickness of each individual element to better tailor ink distribution. For example, if the application is such that ink will be more rapidly withdrawn from the upper portion of the ink reservoir, a large number of thinner ink-carrying elements 50 could be included in the upper portion of the ink reservoir and a lower number of thicker ink-carrying elements in the lower portion. This variation will maintain a more constant distribution of ink under the stated condition. The optimum number of elements 50 and their corresponding thicknesses can be experimentally determined depending upon the configuration of the ribbon cassette and the intended application for which the ribbon cassette is designed.

Because the ink gradient of an ink reservoir formed in accordance with the present invention can be tailored, the flow of ink onto a ribbon via a transfer roller can be tailored. Tailoring ensures the desired ink density in the ribbon and, thus, the desired print density and clarity will be achieved.

Figure 5:
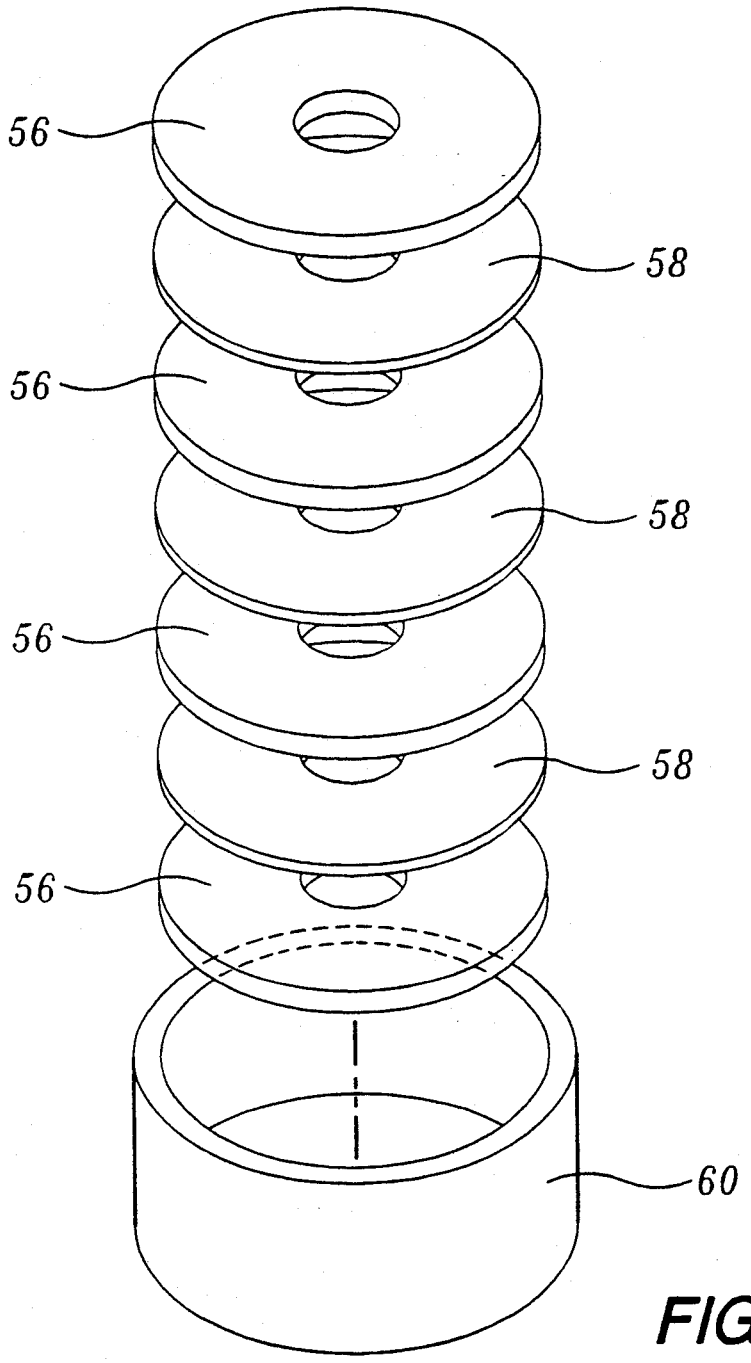
FIG. 5 is an enlarged, exploded view of a second embodiment of an ink reservoir according to the invention.
Figure 6:
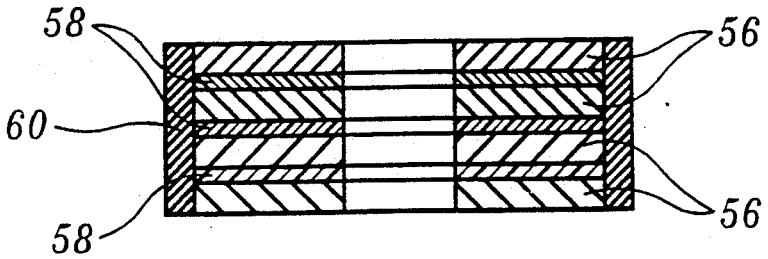
FIG. 6 is a cross-section, elevational view of the ink reservoir of FIG. 5.

FIGS. 5 and 6 illustrate a second embodiment of an ink reservoir according to the present invention. The ink reservoir illustrated in FIGS. 5 and 6 includes a center portion formed of a series of vertically stacked circular ink-carrying elements 56 separated by circular separating sheets 58. This structure is similar to the structure of the first embodiment of the invention described above. The major difference between the first and second embodiments is the inclusion of a cylindrical sleeve 60 in the second embodiment that surrounds the exterior of the ink-carrying elements and the separating sheets. The cylindrical sleeve 60 is formed of a foam whose density is greater than the density of the ink-carrying elements 56. The difference in density allows the sleeve 60 to regulate the flow of ink from the ink carrying elements 56 onto the transfer roller and allows the ink-carrying elements 56 to be formed from a less dense foam. The use of a less dense foam to form the ink-carrying elements and a more dense foam to form the sleeve may allow the ink reservoir to hold more ink than in the first embodiment. The use of a less dense foam in the first embodiment could result in too much ink flowing from the ink reservoir onto the transfer roller. On the other hand, the more ink stored in the ink reservoir, the longer the usable life of the ribbon cassette.

In summary, the center portion of the ink reservoir holds the majority of the serve ink. As with the first embodiment of the invention, an even distribution of ink is maintained throughout the center portion of the ink reservoir by the combination of the ink-carrying elements 56 and the separating sheets 58. Ink slowly flows from the ink-carrying elements 56 to the sleeve 60. As a result, an even distribution of ink is maintained across the sleeve. This, in turn, results in an even flow of ink onto the transfer roller and, thus, onto the ribbon. The use of a less dense center section combined with a more dense sleeve 60 allows the ink reservoir of the second embodiment to hold a larger quantity of ink, which extends the useful life of a ribbon cassette.

It is to be understood that although the ink reservoir of the present invention has been described in combination with a specific ribbon cassette design, an ink reservoir formed in accordance with the present invention can be used in numerous different ribbon cassette designs. In addition, although the ink reservoir is discussed in the context of a rotatable cylinder, the present invention contemplates ink reservoirs having other shapes. As an example, the ink reservoir could be a rectangular ink reservoir that is in fluid contact with a rotatable transfer roller or series of individual transfer rollers. Such an ink reservoir configuration will provide an even distribution of ink to each transfer roller and, in turn, on the ribbon whose ink is supplied by the transfer roller. Thus, while the preferred embodiments of the invention have been illustrated and described, it is to be understood that within the scope of the invention various changes can be made therein.

The embodiments of the invention in which an exclusive property or privilege is claimed are defined as follows:

1. An ink reservoir for use in re-inking a printing ribbon with an even distribution of a single color of ink, said ink reservoir comprising:

at least two vertically stacked, porous ink-carrying elements containing the same color of ink; and at least one separating sheet located between each adjacent pair of ink-carrying elements for substantially preventing the flow of ink between said adjacent ink-carrying elements so as to maintain an even distribution of a single color of ink throughout the height of the ink reservoir.

2. The ink reservoir recited in claim 1, further comprising an exterior element located in fluid contact with said ink-carrying elements for carrying ink from said ink-carrying elements to an external device, said exterior element being formed of a porous material whose density is greater than the density of said ink-carrying elements.

3. The ink reservoir recited in claim 1 or 2, wherein said ink-carrying elements and said separating sheets are circular.

4. The ink reservoir recited in claim 1, wherein the exterior element is a cylindrical sleeve that surrounds said ink-carrying elements.

5. The ink reservoir recited in claim 1, wherein an exterior edge of each separating sheet ends slightly inward from an exterior edge of each of the ink-carrying elements said separating sheet is located between.

6. The ink reservoir recited in claim 5, further comprising an exterior element located in fluid contact with said ink-carrying elements for carrying ink from said ink-carrying elements to an external device, said exterior elements being formed of a porous material whose density is greater than the density of said ink-carrying elements.

7. The ink reservoir recited in claim 5 or 6, wherein said ink-carrying elements and said separating sheets are circular.

8. The ink reservoir recited in claim 7, wherein the exterior element is a cylindrical sleeve that surrounds said ink-carrying elements.

9. The ink reservoir recited in claim 1 or 5, wherein the ink-carrying elements are formed from a porous foam.

10. The ink reservoir recited in claim 9, wherein said porous foam is a polyester foam.

11. The ink reservoir recited in claim 9, wherein said porous foam is a polyurethane foam.

12. In a ribbon cassette comprising a case having an inlet and an outlet, an endless ribbon housed within the case and looping outside of the case through said inlet and outlet, a circular ink reservoir for containing a single color of ink rotatably mounted to the case, and a transfer roller rotatably mounted to the case so as to rotatably engage the ink reservoir and the ribbon such that ink is transferred from the ink reservoir to the ribbon as the transfer roller rotates, the improvement comprising:

an ink reservoir including at least two vertically stacked, porous ink-carrying elements containing the same color ink; and at least one separating sheet located between each adjacent pair of ink-carrying elements for substantially preventing the flow of ink between said adjacent ink-carrying elements so as to maintain an even distribution of a single color of ink throughout the height of the ink reservoir.

13. The improvement claimed in claim 12, wherein the number of ink-carrying elements is four and the number of separating sheets is three.

14. The improvement claimed in claim 12 or 13, wherein the ink reservoir further includes a cylindrical sleeve at least partially surrounding the ink-carrying elements for carrying ink from the ink-carrying elements to the transfer roller.

15. The improvement claimed in claim 14, wherein the density of the cylindrical sleeve is greater than the density of the ink-carrying elements.

16. The improvement claimed in claim 15, wherein the ink-carrying elements are formed from a porous foam.

17. The improvement claimed in claim 16, wherein the porous foam is a polyester foam.

18. The improvement claimed in claim 16, wherein the porous foam is a polyurethane foam.

* * * * *

UNITED STATES PATENT AND TRADEMARK OFFICE

CERTIFICATE OF CORRECTION

PATENT NO. : 5,230,575

DATED : July 27, 1993

INVENTOR(S) : L. B. Kulesa et al.

It is certified that error appears in the above-identified patent and that said Letters Patent is hereby corrected as shown below:

| COLUMN | LINE | |
|---|---|---|
| 1 | 21 | after "flows" insert --from-- |
| 5 | 52 | "thickness" should read --thicknesses-- |
| 6 | 67 | "serve" should read --reserve-- |

Signed and Sealed this

Twenty-sixth Day of April, 1994

*Attest:*

*Attesting Officer*

BRUCE LEHMAN

*Commissioner of Patents and Trademarks*